US007877889B2

(12) United States Patent
Griffin, Jr.

(10) Patent No.: US 7,877,889 B2
(45) Date of Patent: Feb. 1, 2011

(54) ANCHOR BOLT POSITIONING SYSTEM

(76) Inventor: Jack C. Griffin, Jr., 676 Gibbs Rd., Laurens, SC (US) 29360

( * ) Notice: Subject to any disclaimer, the term of this patent is extended or adjusted under 35 U.S.C. 154(b) by 380 days.

(21) Appl. No.: 12/074,579

(22) Filed: Mar. 5, 2008

(65) Prior Publication Data

US 2009/0223165 A1 Sep. 10, 2009

(51) Int. Cl.
*G01B 3/00* (2006.01)

(52) U.S. Cl. ..... 33/562; 33/454; 249/155

(58) Field of Classification Search ..... 33/562–563, 33/613, 645, 25.1, 25.2, 25.3, 454, 464; 52/295, 52/699; 425/111; 249/3, 5, 16, 34, 38, 97, 249/155

See application file for complete search history.

(56) References Cited

U.S. PATENT DOCUMENTS

| | | | | | |
|---|---|---|---|---|---|
| 363,025 | A | * | 5/1887 | Walker | 33/454 |
| 826,759 | A | * | 7/1906 | Branch | 33/464 |
| 910,883 | A | * | 1/1909 | Turkington | 249/22 |
| 913,441 | A | * | 2/1909 | Taubert | 425/63 |
| 975,242 | A | * | 11/1910 | Higgins et al. | 249/29 |
| 1,554,420 | A | * | 9/1925 | Donley | 249/34 |
| 1,661,096 | A | * | 2/1928 | Rowe | 33/456 |
| 1,756,542 | A | * | 4/1930 | Dowd | 249/49 |
| 1,954,447 | A | * | 4/1934 | Greenway | 249/155 |
| 2,416,559 | A | * | 2/1947 | Wilson | 249/16 |
| 2,475,890 | A | * | 7/1949 | Hamilton | 249/49 |
| 2,636,426 | A | * | 4/1953 | Heltzel et al. | 249/9 |
| 2,652,866 | A | * | 9/1953 | Drain | 144/144.51 |
| 2,674,042 | A | * | 4/1954 | Ott | 33/25.2 |
| 2,887,756 | A | * | 5/1959 | Brechel | 249/13 |
| 3,207,465 | A | * | 9/1965 | Papin | 249/34 |
| 3,219,308 | A | | 11/1965 | Halstead | |
| 3,475,819 | A | * | 11/1969 | Glavan | 33/25.1 |
| 3,687,411 | A | * | 8/1972 | Frazier | 249/44 |
| 3,751,790 | A | * | 8/1973 | Frazier | 29/455.1 |
| 3,790,121 | A | * | 2/1974 | Sels et al. | 249/219.1 |
| 3,938,776 | A | * | 2/1976 | Frazier | 249/114.1 |
| 3,939,564 | A | * | 2/1976 | Slawinski, Sr. | 33/1 K |
| 3,963,210 | A | | 6/1976 | Macklin | |
| 4,239,176 | A | * | 12/1980 | Salazar | 249/97 |
| 4,261,544 | A | | 4/1981 | Addison | |
| 4,321,024 | A | * | 3/1982 | Terraillon | 425/111 |
| 4,451,022 | A | * | 5/1984 | Sauger | 249/2 |
| 4,736,554 | A | | 4/1988 | Tyler | |
| 5,060,436 | A | | 10/1991 | Delgado, Jr. | |
| 5,332,191 | A | * | 7/1994 | Nolan | 249/155 |
| 5,375,339 | A | | 12/1994 | Noel, Jr. | |
| 5,836,132 | A | | 11/1998 | Weathersby | |

(Continued)

OTHER PUBLICATIONS

Northwest Plastics, Advertisement for BOLT-RITE® Anchor Bolt Positioning System Thread Protectors, www.boltrite.com, Publication Date Unknown, copy enclosed (1 page).

*Primary Examiner*—G. Bradley Bennett
*Assistant Examiner*—Tania C Courson
(74) *Attorney, Agent, or Firm*—J. Bennett Mullinax, LLC

(57) ABSTRACT

An anchor bolt positioning system is provided. In one exemplary embodiment, an anchor bolt holder is present and is configured for holding an anchor bolt. The anchor bolt holder may be selectively positioned along a first rail and may be selectively positioned along a second rail.

20 Claims, 4 Drawing Sheets

U.S. PATENT DOCUMENTS 6,195,903 B1 * 3/2001 Inglehart ..... 33/454
6,629,681 B1 * 10/2003 Miller et al. ..... 249/3
6,643,945 B1 11/2003 Starks
6,854,227 B2 2/2005 Grendahl
7,103,984 B2 9/2006 Kastberg
7,290,749 B1 * 11/2007 Jessop et al. ..... 249/34
7,331,560 B2 * 2/2008 Jessop et al. ..... 249/34
2006/0016140 A1 * 1/2006 Smith ..... 52/295

* cited by examiner

ANCHOR BOLT POSITIONING SYSTEM

FIELD OF THE INVENTION

The present invention relates generally to a system for use in positioning anchor bolts in concrete. More particularly, the present application involves an anchor bolt positioning system that may be capable of locating and securely holding variously sized anchor bolts for mounting within concrete.

BACKGROUND

Commercial and residential construction projects employ the use of anchor bolts for holding structural elements or other members to concrete. For example, anchor bolts may be used to securely attach foundation walls, light posts, heating ventilating and air conditioning units, and communications equipment to concrete slabs. Anchor bolts can be mounted into dried or cured concrete. In this type of instillation, the dried concrete slab must be drilled at the selected location. Subsequently, a bolt having a split sleeve is used to effect attachment therein. Although such a mounting technique allows for anchor bolts to be properly secured within concrete, costs are usually high due to the necessary drilling and complex bolt attachment.

A second manner of mounting anchor bolts into concrete involves positioning the anchor bolt within a form and subsequently pouring wet concrete into the form. Such an arrangement negates the need to drill into the concrete as the wet concrete cures around the previously positioned anchor bolts. However, certain challenges exist in properly positioning and holding anchor bolts in place while pouring wet concrete. For example, the anchor bolts must be accurately located before the concrete is poured as repositioning subsequent to curing of the concrete, due to a mistake, is both labor intensive and costly. Further, forces acting upon the positioned anchor bolts due to the flow of wet concrete may cause them to turn or otherwise shift out of place.

Templates are known for use in positioning and holding anchor bolts in place while wet concrete is poured into a form and subsequently cures around the anchor bolts to permanently fix them in position. One such template is a square plate that has a series of apertures that extend from its center. A user may place a nut onto a threaded portion of an anchor bolt and may subsequently place the bolt through a particular aperture of the template. The user may then place a second nut onto the threaded portion of the anchor bolt and tighten the second nut onto the plate so that the anchor bolt is held onto the template. Corresponding apertures may be employed in a similar fashion so that four anchor bolts can be positioned on the template at a selected center-to-center distance. The template and attached anchor bolts are placed on top of a concrete form and wet concrete is poured therein. After the concrete has cured to thus encase the anchor bolts, the second nuts can be loosened and removed to allow the template to be subsequently lifted and removed.

The apertures extend an equal, predetermined distance from the center of the template so that the anchor bolts can be positioned in square shaped configurations of different sizes. Concentric knock-out portions that are stamped, scored or otherwise weakened surround the apertures. It may be the case that an anchor bolt with a diameter larger than the aperture is desired to be embedded in concrete. In these instances, the knock-out portion can be removed so that the size of the aperture is extended in order to accommodate the larger diameter anchor bolt. Although instruments are known to aid in the positioning of anchor bolts within concrete, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
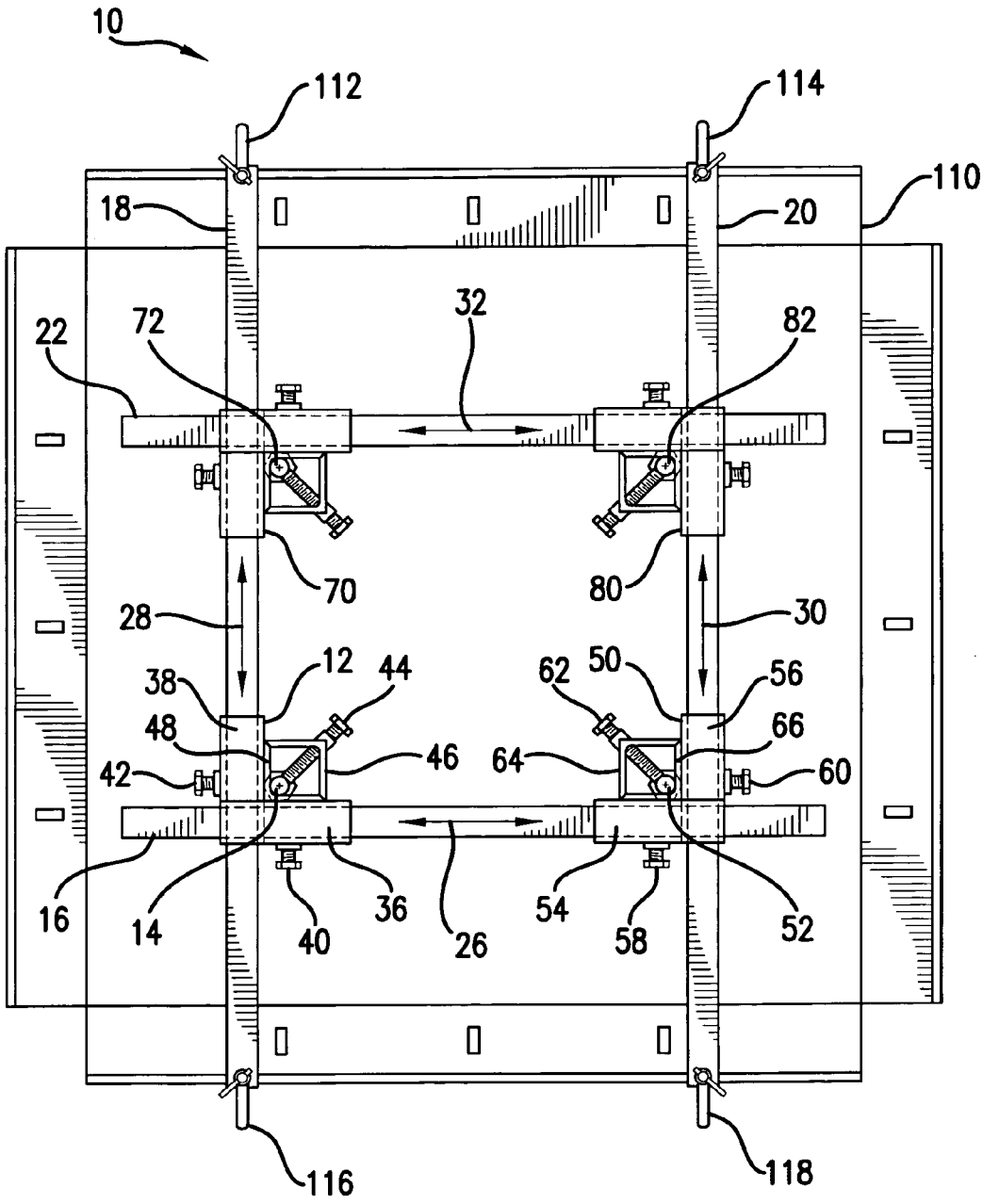
FIG. 1 is a top view of an anchor bolt positioning system in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an anchor bolt positioning system 10 for use in positioning and holding anchor bolts 14 in place for encasement within concrete. The anchor bolt positioning system 10 allows for any number of anchor bolts 14 to be positioned in a variety of locations with respect to a form 110 into which wet concrete is poured. The anchor bolt positioning system 10 may be arranged so that certain anchor bolts 14 are in communication with one another so that repositioning of one anchor bolt 14 causes a corresponding repositioning of one or more associated anchor bolts 14. The anchor bolt positioning system 10 may also be arranged in a robust manner such that the anchor bolts 14 are securely held during pouring of wet concrete so that the anchor bolts 14 do not turn, rotate or otherwise move out of their desired position. Further, the anchor bolt positioning system 10 may also be provided so as to be capable of holding anchor bolts 14 having various diameters.

One exemplary embodiment of an anchor bolt positioning system 10 is illustrated in FIG. 1. As shown, the anchor bolt positioning system 10 is used to position a plurality of anchor bolts 14, 52, 72 and 82 with respect to a form 110 into which wet concrete is poured. It is to be understood that as used herein, the term form refers to any structure, depression or combination of the two into which wet concrete is placed for subsequent curing. The form 110 may include wooden, metal, concrete or ceramic members that define a cavity of a desired shape into which wet concrete is poured to achieve a particular cured slab. In alternative embodiments, the form 110 may be simply a depression formed in the earth that includes no structural members. The form 110 may also include other elements such as rebar or electrical conduits or lines that function to strengthen and/or provide additional functionality to the resulting concrete slab. As such, the form 110 may be made in a variety of manners in a variety of shapes in accordance with various exemplary embodiments.

The anchor bolt positioning system 10 includes a first anchor bolt holder 12 that functions to position a first anchor bolt 14 at a particular location with respect to the form 110. As such, the first anchor bolt 14 may be desirably positioned with respect to the form 110, and wet concrete may be subsequently poured into the form 110 while the first anchor bolt 14 is maintained in the desired position. The anchor bolt positioning system 10 is capable of securely holding the first anchor bolt 14 in place so that it resides in the same location during pouring and subsequent curing of the concrete to thus result in a hardened concrete slab having a first anchor bolt 14 embedded therein at a desired location.

The first anchor bolt holder 12 has an anchor bolt set screw 44 that engages the first anchor bolt 14 and holds the first anchor bolt 14 against a pair of anchor bolt plates 46 and 48 to thus retain the first anchor bolt 14 on the first anchor bolt holder 12. The anchor bolt set screw 44 can be threaded to the first anchor bolt holder 12. A user may rotated the anchor bolt set screw 44 through the use of a wrench or other member to tightly engage the first anchor bolt 14 for retention. However, it is to be understood that the anchor bolt set screw 44 need not be tightened through the use of a tool but may instead be simply hand tightened in order to retain the first anchor bolt 14 in accordance with other embodiments. The first anchor bolt plate 46 has a flat surface that is oriented at a ninety degree angle to a flat surface of the second anchor bolt plate 48. As such, tightening of the anchor bolt set screw 44 causes a three point engagement of the first anchor bolt 14 to be realized to thus effect attachment to the first anchor bolt holder 12. The anchor bolt set screw 44 is oriented so as to be moved closer to and farther from the intersection of the first and second anchor bolt plates 46 and 48. A pair of flat mounting members extend from the anchor bolt plates 46 and 48 in order to mount the anchor bolt set screw 44 thereon. However, the first anchor bolt holder 12 can be variously arranged in accordance with other exemplary embodiments. For instance, a curved surface may be located opposite the anchor bolt set screw 44 so that the first anchor bolt 14 is engaged along a portion of its diameter in addition to being engaged at the anchor bolt set screw 44. Still further, only a single, flat anchor bolt plate may be present such that the anchor bolt set screw 44 is engaged at two locations being the flat plate and the anchor bolt set screw 44.

The first anchor bolt holder 14 may be capable of holding anchor bolts 14 that have various diameters. In this regard, a larger first anchor bolt 14 can be located against the first and second anchor bolt plates 46 and 48 and the anchor bolt set screw 44 can be turned towards the larger first anchor bolt 14 to thus engage the larger first anchor bolt 14 and effect retention in a similar manner. The only difference in this regard is that the anchor bolt set screw 44 need not be moved as great a distance in order to engage the larger first anchor bolt 14. As such, the anchor bolt set screw 44 affords retention of anchor bolts 14 having various diameters. Further, the anchor bolt set screw 44 is capable of engaging and retaining anchor bolts 14 regardless of the presence of threading on the anchor bolts 14. As such, the first anchor bolt 14 may have threading located thereon in accordance with one exemplary embodiment or may be lacking threading at the location of engagement or at any other point along its length in accordance with other exemplary embodiments.

Although shown as having flat faces oriented at ninety degrees from one another, it is to be understood that the first anchor bolt plate 46 and the second anchor bolt plate 48 may have faces that are oriented at a variety of degrees in accordance with other embodiments. For instance, the first and second anchor bolt plates 46 and 48 may have flat faces that are oriented at angles from forty five degrees to one hundred and sixty degrees in accordance with various exemplary embodiments. Although shown as being capable of retaining anchor bolts 14 of multiple diameters, it is to be understood that the anchor bolt positioning system 10 can be arranged differently in other embodiments so that only anchor bolts 14 of a particular diameter are capable of being retained to the first anchor bolt holder 12. For example, the first anchor bolt holder 12 may have a horizontally oriented plate with a specifically sized aperture located therethrough for accepting a particularly sized first anchor bolt 14. Further, the first anchor bolt holder 12 may have a bore with a particular type of threading to receive a first anchor bolt 14 of a particular size with complimentary threading. As such, various exemplary embodiments exist in which the anchor bolt positioning system 10 may accommodate anchor bolts 14 of various diameters or of particular diameters.

The first anchor bolt holder 12 is in sliding engagement with a first rail 16 and can be selectively positioned along a length 26 of the first rail 16. The length 26 of the first rail 16 is an extending portion of the first rail 16 that is larger than a cross-sectional portion of the first rail 16. The length 26 of the first rail 16 may be the entire extending portion of the first rail 16 or may be only part of the extending portion of the first rail 16. As such, the first anchor bolt holder 12 may be capable of being positioned along the length 26 of the first rail 16 that may be the entire length 26 of the first rail 16 or only a portion of the length 26 of the first rail. Therefore, as used herein, the term length refers to at least a portion of the extending portion of the rail. Further, it is to be understood as used herein that the term rail refers to a component along which the position of an anchor bolt holder may or may not be varied. Although shown as being rectangular in shape with a rectangular shaped cavity, the rails can be variously shaped in accordance with other exemplary embodiments. The rails may be a permanent part of the form 110 or other structure left in place after setting of the concrete. Alternatively, the rails may be a component that can be removed from the form 110 or other structure that remains in place with the anchor bolts.

The first anchor bolt holder 12 may be moved to a desired location along the length 26 of the first rail 16. In this regard, the first rail 16 may have a rectangular shaped outer surface and the first anchor bolt holder 12 may have a first sleeve 36 that defines a complimentary rectangular shaped cavity. The first sleeve 36 may extend around a portion of the first rail 16 so that the first sleeve 36 can slide along the length 26 of the first rail 16 to thus allow the first anchor bolt holder 12 to be positioned along length 26. Although described as being rectangular in shape, the outer surface of the first rail 16 and the cavity of the first sleeve 36 may be variously shaped in other embodiments. For example, these elements may be circular shaped, oval shaped, channel shaped, or irregular in shape in accordance with other versions of the anchor bolt positioning system 10.

The first anchor bolt holder 12 may include a first sleeve set screw 40 that extends through a wall of the first sleeve 36. Once the first anchor bolt holder 12 has been placed into a desired position along the length 26 of the first rail 16, the first sleeve set screw 40 can be tightened in order to engage the first rail 16 and thus fix the position of the first anchor bolt holder 12 with respect to the first rail 16. The first sleeve set screw 40 can be subsequently loosened in order to be disengaged from the first rail 16 to allow the first anchor bolt holder 12 to be repositioned to a different location along the length 26. The first sleeve set screw 40 can be tightened through the use of a wrench or other tool. Additionally or alternatively, the first sleeve set screw 40 can be hand tightened in order to effect attachment of the first anchor bolt holder 12 to the first rail 16. Although shown as using first sleeve set screw 40, the position of the first anchor bolt holder 12 along the length 26 of the first rail 16 can be fixed in a variety of manners in accordance with other exemplary embodiments. For example, clips, pins, frictional members or other elements may be used to fix the position of the first anchor bolt holder 12 with respect to the first rail 16 in other versions of the anchor bolt positioning system 10.

The first anchor bolt holder 12 includes a second sleeve 38 that is located below the first sleeve 36 as more clearly shown with reference to FIG. 2. It is to be understood, however, that in other arrangements of the first anchor bolt holder 12 that the first sleeve 36 may be below the second sleeve 38 or may be at the same location as the second sleeve 38. The second sleeve 38 defines a cavity that is rectangular in shape and is oriented at a ninety degree angle to the cavity defined by the first sleeve 36. The second sleeve 38 surrounds a portion of a rectangular shaped outer surface of a second rail 18. The second rail 18 has a length 28 that extends in a direction oriented at a ninety degree angle to that of the length 26 of the first rail 16. The second sleeve 38 may be slid along the length 28 of the second rail 18 so that the position of the first anchor bolt holder 12 can thus be varied along length 28. Although shown as being rectangular in shape, the cavity of the second sleeve 38 and the outer surface of the second rail 18 may be variously shaped and configured as previously discussed with respect to the first sleeve 36 and the first rail 16.

The first anchor bolt holder 12 may include a second sleeve set screw 42 that can be used to engage the second rail 18 in order to fix the position of the first anchor bolt holder 12 with respect to the second rail 18. In this regard, the first anchor bolt holder 12 can be moved to a desired location along length 28 and the second sleeve set screw 42 can be turned in order to engage the second rail 18 and thus lock the position of the first anchor bolt holder 12 along length 28. The second sleeve set screw 42 can be subsequently loosened in order to disengage the second rail 18 to allow the first anchor bolt holder 12 to be moved to a newly desired location along length 28. Various arrangements can be used in order to fix the location of the first anchor bolt holder 12 along length 28, and the second sleeve 38 and the second sleeve set screw 42 need not be present in other embodiments. For example, the arrangements are previously discussed with respect to the first sleeve set screw 40 and the first rail 16 may be used in accordance with other exemplary embodiments.

The first rail 16 and the second rail 18 have respective lengths 26 and 28 that extend at a ninety degree angle to one another. In this manner, the anchor bolt holder 12 can be positioned via sleeves 36 and 38 to various locations along lengths 26 and 28 to thus cause the first anchor bolt 14 to be positioned at a desired location with respect to the form 110. The first sleeve set screw 40 and the second sleeve set screw 42 can be tightened in order to lock the position of the first anchor bolt 14 with respect to the form 110 so that wet concrete can be subsequently added to the form 110 to thus encase the first anchor bolt 14 therein. The first anchor bolt 14 may be securely held by the anchor bolt set screw 44 against the first anchor bolt plate 46 and the second anchor bolt plate 48 so that the first anchor bolt 14 does not pivot, turn, tip or otherwise move during the wet cement pouring and subsequent curing.

The anchor bolt positioning system 10 may be capable of positioning and holding additional anchor bolts as may be required for mounting or holding various pieces of machinery and other structural elements. In this regard, a second anchor bolt holder 50 can be present and may have a first sleeve 54 that surrounds a portion of the first rail 16. The first sleeve 54 may define a rectangular shaped cavity that fits around a complimentary rectangular outer surface of the first rail 16 so that the first sleeve 54 may slide along the length 26 of the first rail 16. However, the first sleeve 54 need not have a shape that matches the first rail 16 in other exemplary embodiments. The second anchor bolt holder 50 holds a second anchor bolt 52. Movement of the first sleeve 54 with respect to the first rail 16 causes a corresponding movement of the second anchor bolt holder 50 and the second anchor bolt 52. As such, the first sleeve 54 can be moved along the length 26 of the first rail 16 in order to move the second anchor bolt 52 closer to and farther from the first anchor bolt 14 as desired.

The second anchor bolt 52 may be retained on the second anchor bolt holder 50 in a manner similar to that previously discussed with respect to the first anchor bolt holder 12 and the first anchor bolt 14. Specifically, a first anchor bolt plate 64 and a second anchor bolt plate 66 can be present having flat surfaces oriented at a ninety degree angle to one another. The second anchor bolt 52 can be located against this pair of plates 64 and 66 and an anchor bolt set screw 62 may be actuated in order to press the second anchor bolt 52 against plates 64 and 66. This arrangement may allow for variously sized second anchor bolts 52 to be retained by the second anchor bolt holder 50 as previously discussed with respect to the first anchor bolt holder 12. Further, other attachment arrangements are possible between the second anchor bolt holder 50 and the second anchor bolt 52 as previously discussed with respect to the first anchor bolt holder 12 and the first anchor bolt 14 and a repeat of this information is not necessary.

The second anchor bolt holder 50 may also include a second sleeve 56. A third rail 20 can be included in the anchor bolt positioning system 10 that has a length 30. The length 30 of the third rail 20 may be parallel to length 28 of the second rail 18. Also, length 30 can be perpendicular to length 26 of first rail 16. The second sleeve 56 surrounds a portion of the third rail 20 and may be arranged in manners similar to those discussed previously with respect to other sleeves and rails. The second sleeve 56 may be capable of being positioned along the length 30 of the third rail 20 so that the position of the second anchor bolt 52 can be adjusted with respect to the form 110. The second anchor bolt holder 50 is thus adjustable so that the second anchor bolt 52 can be variously placed with respect to the form 110. Once a desired position is reached, a first sleeve set screw 58 can be actuated in order to lock the position of the second anchor bolt 52 with respect to the first rail 16. Further, a second sleeve set screw 60 can be present in order to fix the position of the second sleeve 56, and hence second anchor bolt 52, with respect to the third rail 20.

The first anchor bolt holder 12 and the second anchor bolt holder 50 both surround portions of the first rail 16. As such, these two holders 12 and 50 are tied to one another in that movement of the first rail 16 may cause a corresponding movement of both of the holders 12 and 50. For example, movement of the first rail 16 along the lengths 28 and 30 of the second and third rails 18 and 20 causes corresponding movement of the first and second anchor bolt holders 12 and 50 along lengths 28 and 30. In a similar manner, movement of the first anchor bolt holder 12 along the length 28 causes movement of the first rail 16 along length 28 and movement of the second anchor bolt holder 50 along length 30 of the third rail 20. Tying certain movements of the first and second anchor bolt holders 12 and 50 to one another allows for similar repositioning of the first and second anchor bolts 14 and 52 as equipment to be mounted sometimes requires a pair of anchor bolt in a linear arrangement to one another. However, it is to be understood that the first and second anchor bolt holders 12 and 50 may be variously arranged in other embodiments such that movement of one along one of lengths 28 or 30 does not cause a corresponding movement of the other holder 12 or 50 along their respective length 28 or 30.

The anchor bolt positioning system 10 may be provided with any number of anchor bolt holders for use in positioning any number of anchor bolts with respect to form 110. As shown in FIGS. 1 and 2, a third anchor bolt holder 70 is present in order to hold a third anchor bolt 72. Retention of the third anchor bolt 72 to the third anchor bolt holder 70 may be effected as previously discussed with respect to other anchor bolt holders and anchor bolts and need not be presently repeated. The third anchor bolt holder 70 may be capable of being positioned along length 28 of the second rail 18 so that its distance from the first anchor bolt holder 12 can be increased or decreased. The third anchor bolt holder 70 may also be retained on a fourth rail 22 and can be repositioned along its length 32. The length 32 of the fourth rail 22 is parallel to the length 26 of the first rail 16 and is perpendicular to both length 28 and length 30 of the second rail 18 and the third rail 20. The third anchor bolt holder 70 can be arranged in manners similar to those discussed with respect to other anchor bolt holders and a repeat of this information is not necessary.

The anchor bolt positioning system 10 also includes a fourth anchor bolt holder 80 that carries a fourth anchor bolt 82. The fourth anchor bolt holder 80 may be repositioned along the length 30 of the third rail 20. The fourth anchor bolt holder 80 can also be repositioned along the length 32 of the fourth rail 22. The fourth anchor bolt holder 80 can be repositioned along length 32 so as to be moved closer to and farther from the third anchor bolt holder 70. Also, the fourth anchor bolt holder 80 can be repositioned along length 30 so that it can be moved closer to and farther from the second anchor bolt holder 50. The third anchor bolt holder 70 and the fourth anchor bolt holder 80 are tied to one another such that movement of the fourth rail 22 along lengths 28 and 30 causes a corresponding movement of the third and fourth anchor bolt holders 70 and 80 along lengths 28 and 30. In a similar manner, movement of the second rail 18 along lengths 26 and 32 causes a corresponding movement of the first anchor bolt holder 12 and the third anchor bolt holder 70 along lengths 26 and 32. The second anchor bolt holder 50 and the fourth anchor bolt holder 80 are in communication with one another in a similar manner. In this regard, movement of the third rail 20 along lengths 26 and 32 causes a corresponding movement of the second anchor bolt holder 50 along length 26 and a corresponding movement of fourth anchor bolt holder 80 along length 32.

The anchor bolt positioning system 10 may be arranged so that movement of one of the anchor bolt holders translates into corresponding movement of one or more of the other anchor bolt holders. In this manner, the anchor bolts can be repositioned in a corresponding manner as equipment to be mounted by the anchor bolts sometimes requires anchor bolts that are oriented in a linear fashion. However, it is to be understood that other exemplary embodiments are possible in which none of the anchor bolt holders are in communication with any of the other anchor bolt holders. In this regard, movement of one or more of the anchor bolt holders with respect to the form 110 or other components of the anchor bolt positioning system 10 does not cause a corresponding movement of another anchor bolt holder.

In practice, the position of the second rail 18 and the third rail 20 may be located with respect to the form 110. Once desired positions of the two rails 18 and 20 are obtained, a plurality of C-clamps 112, 114, 116 and 118 may be used in order to lock the rails 18 and 20 to the form 110. The C-clamps 112, 114, 116 and 118 may be mounted to portions of the form 110 or may be mounted to other structural elements in order to fix the position of the rails 18 and 20 with respect to the form 110. Once the position of rails 18 and 20 are locked, the anchor bolt holders 12, 50, 70 and 80 can be moved along lengths 28 and 30 to their desired positions so that the anchor bolts 14, 52, 72 and 82 are properly located with respect to form 110. Next, wet concrete may be poured into form 110. The anchor bolts 14, 52, 72 and 82 may be securely held by the set screw arrangements of their respective holders 12, 50, 70 and 80 so that they do not rotate or otherwise move out of position upon having forces from the wet concrete imposed thereon. The lock-down of C-clamps 112, 114, 116 and 118 may also function to help hold the anchor bolts 14, 52, 72 and 82 in their desired orientation during pouring of wet concrete into form 110. However, it is to be understood that other arrangements are possible in which the C-clamps 112, 114, 116 and 118 are not present. Additionally, other exemplary embodiments are possible in which the rails 16 and/or 22 are retained to the form 110 or other structural element though the use of C-clamps. It is to be understood that other fastening mechanisms are possible in addition to or alternatively to the use of C-clamps such as bolts, straps or interlocking arrangements in accordance with other exemplary embodiments.

Figure 2:
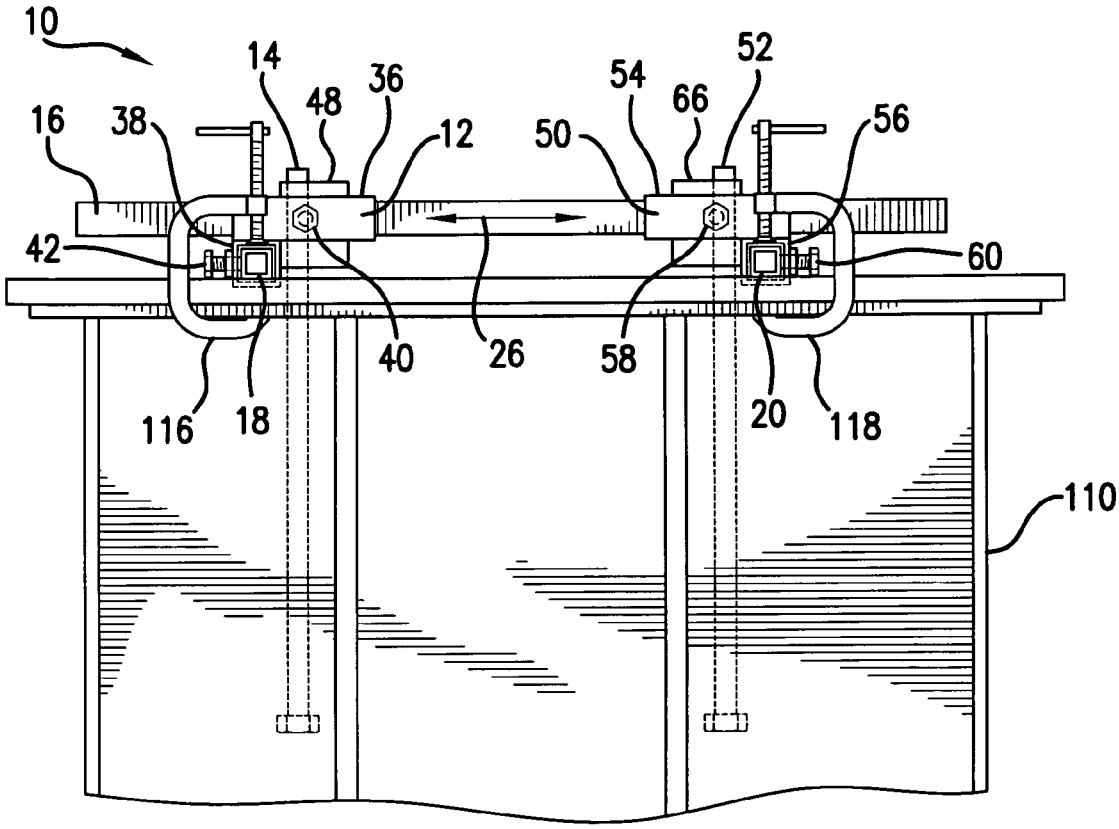
FIG. 2 is a side view of the anchor bolt positioning system of FIG. 1.

The concrete is allowed to cure in the form 110 while the anchor bolt positioning system 10 remains in place as shown in FIGS. 1 and 2. Once the concrete has sufficiently hardened, the anchor bolt set screws of the anchor bolt holders 12, 50, 70 and 80 can be loosened in order to disengage the anchor bolts 14, 52, 72 and 82 from their respective anchor bolt holders 12, 50, 70 and 80. The C-clamps 112, 114, 116 and 118 can also be loosened in order to allow the rails 18 and 20 to be moved with respect to the form 110. The anchor bolt positioning system 10 can then be lifted upwards away from the hardened concrete for removal. The anchor bolts 12, 52, 72 and 82 remain in the cured concrete for subsequent attachment to equipment or other structural elements. The anchor bolt positioning system 10 can be reused for the positioning of other anchor bolts having various diameters or configurations as desired. The anchor bolt positioning system 10 allows concrete to be worked on or finished in areas between the anchor bolts 12, 52, 72 and 82 as sufficient room and space is available to do so as a result of its construction.

Figure 3:
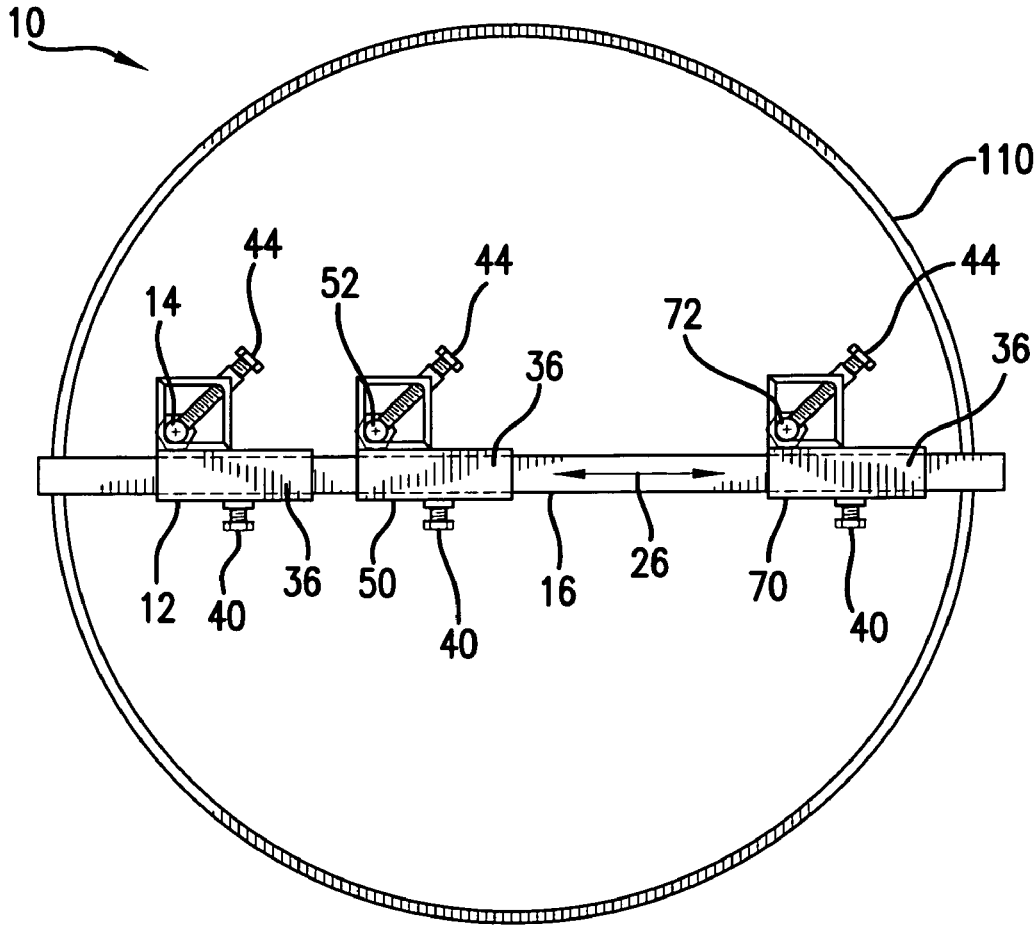
FIG. 3 is a top view of an anchor bolt positioning system in accordance with another exemplary embodiment.

An additional exemplary embodiment of the anchor bolt positioning system 10 is illustrated in FIG. 3. Here, the form 110 is circular in shape and three anchor bolts 14, 52 and 72 are needed to be positioned into concrete formed into the shape of form 110. The anchor bolts are desired to be placed in a linear arrangement. A first rail 16 is included along which three anchor bolt holders 12, 50 and 70 are positioned. The three anchor bolt holders 12, 50 and 70 may be configured as previously discussed with respect to other exemplary embodiments. However, in the exemplary embodiment of FIG. 3, the anchor bolt holders 12, 50 and 70 need each include only a single sleeve 36 as only a single rail 16 is present. The position of the anchor bolt holders 12, 50 and 70 may be varied along the length 26 of the rail 16 as previously discussed and held into position through the use of first sleeve set screws 40.

The anchor bolts 14, 52 and 72 may be retained onto the three anchor bolt holders 12, 50 and 70 through the use of anchor bolt set screws 44 as previously discussed. Once the anchor bolts 14, 52 and 72 are properly positioned with respect to the form 110, wet concrete may be poured therein and allowed to cure. The anchor bolt set screws 44 can be loosened in order to allow the anchor bolt positioning system 10 to be removed from the anchor bolts 14, 52 and 72.

Figure 4:
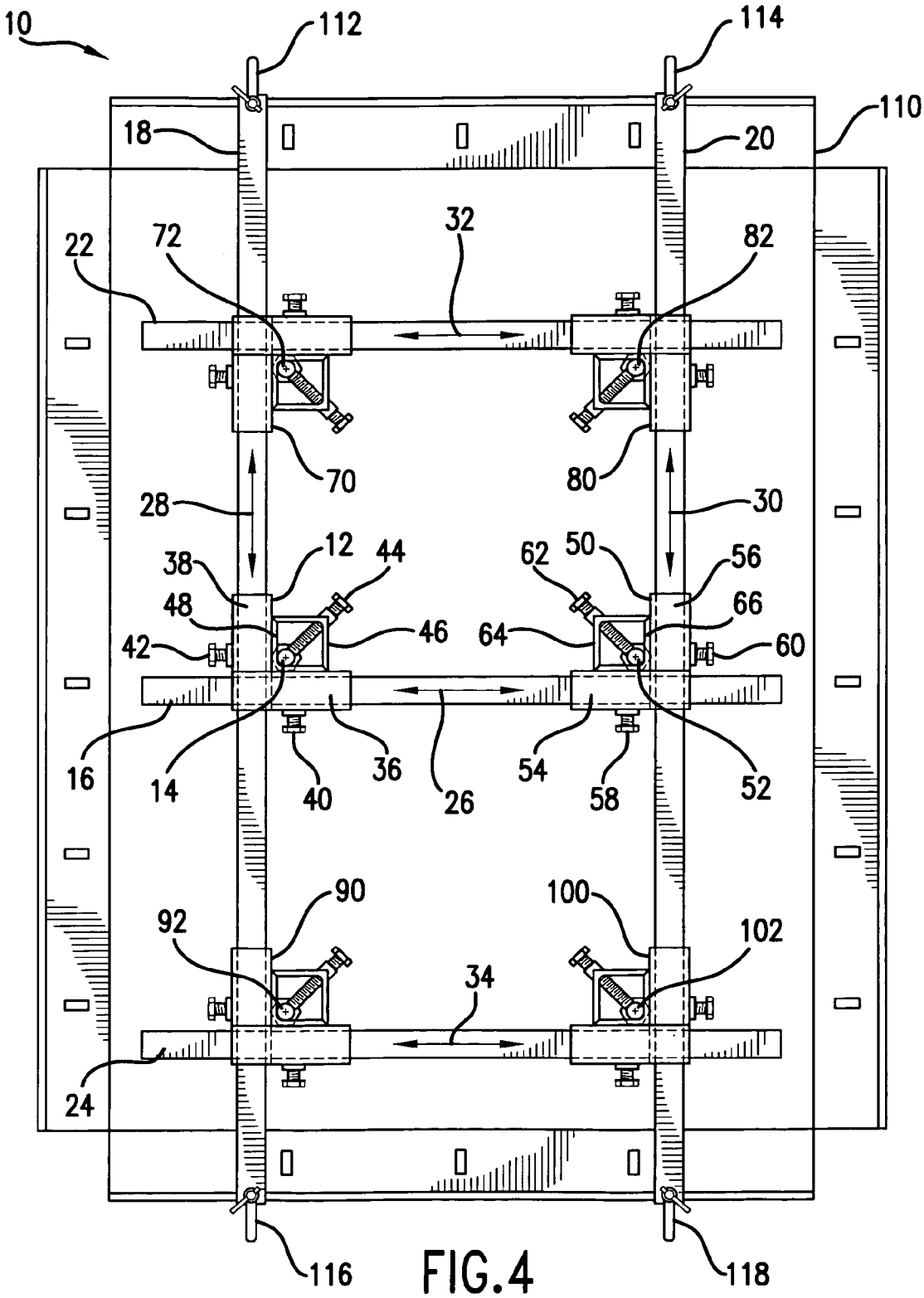
FIG. 4 is a top view of an anchor bolt positioning system in accordance with yet another exemplary embodiment.

Any number of anchor bolt holders can be incorporated into the anchor bolt positioning system 10 in accordance with various exemplary embodiments in order to properly locate any number of anchor bolts. FIG. 4 shows an additional exemplary embodiment that expands on the embodiment illustrated in FIGS. 1 and 2. Here, a fifth anchor bolt holder 90 is present and retains a fifth anchor bolt 92. Additionally, a sixth anchor bolt holder 100 is included and retains a sixth anchor bolt 102. The fifth and sixth anchor bolt holders 90 and 100 may be arranged in a manner similar to anchor bolt holders as previously discussed and a repeat of this information is not necessary. The fifth and sixth anchor bolt holders 90 and 100 are retained on a fifth rail 24 that has a length 34 that is parallel to lengths 26 and 32 and is perpendicular to lengths 28 and 30.

The fifth and sixth anchor bolt holders 90 and 100 can be moved closer to or farther from one another along length 34 of the fifth rail 24 as desired. The fifth and sixth anchor bolt holders 90 and 100 are in communication with one another such that movement of the fifth rail 24 along lengths 28 and 30 cause a corresponding movement of the fifth and sixth anchor bolt holders 90 and 100 along the lengths 28 and 30 of the second rail 18 and third rail 20. The retention of the fifth anchor bolt holder 90 on the second rail 18 likewise causes the fifth anchor bolt holder 90 to move in unison with the first anchor bolt holder 14 and the third anchor bolt holder 70 when one or more of these components move in relation to the lengths 26, 32 or 34. The sixth anchor bolt holder 100 will also move with the second anchor bolt holder 50 and the fourth anchor bolt holder 80 when one of these components or rail 20 is moved in relation to lengths 26, 32 or 34. Additional anchor bolt holders may be incorporated into the anchor bolt positioning system 10 as desired in order to position any number of anchor bolts in accordance with various exemplary embodiments.

Although shown as having a particular construction, it is to be understood that the rails 16, 18, 20, 22 and 24 can be variously configured in accordance with other exemplary embodiments. For example, the rails 16, 18, 20, 22 and 24 may be items that are found at the construction site such as rebar form stakes or pipes. Further, other modifications are possible. For example, the anchor bolt holders, such as the first anchor bolt holder 12, need not include sleeves 36 and 38 in certain exemplary embodiments. In these instances, the anchor bolt holders may employ a configuration resembling the way the anchor bolt 12 is attached thereto through the use of the anchor bolt set screw 44, the first anchor bolt plate 46 and the second anchor bolt plate 48.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An anchor bolt positioning system, comprising:

an anchor bolt holder configured for holding an anchor bolt, wherein the anchor bolt holder is configured for being selectively positioned along a first rail, wherein the anchor bolt holder is configured for being selectively positioned along a second rail, wherein once the anchor bolt holder is positioned to a desired location along the first rail and to a desired location along the second rail the anchor bolt is embedded in concrete.

2. The anchor bolt positioning system as set forth in claim 1, further comprising:

the first rail; and the second rail, wherein the length of the first rail is oriented at a ninety degree angle to the length of the second rail such that the anchor bolt holder is capable of being selectively positioned along the ninety degree oriented lengths of the first rail and the second rail.

3. The anchor bolt positioning system as set forth in claim 1, wherein the anchor bolt holder has a first sleeve that surrounds a portion of the first rail, wherein the anchor bolt holder has a second sleeve that surrounds a portion of the second rail, wherein the first sleeve is capable of sliding along the length of the first rail so as to selectively position the anchor bolt holder along the length of the first rail, wherein the second sleeve is capable of sliding along the length of the second rail so as to selectively position the anchor bolt holder along the length of the second rail.

4. The anchor bolt positioning system as set forth in claim 3, wherein the anchor bolt holder has a first sleeve set screw that is configured for engaging the first rail so as to fix the position of the first sleeve with respect to the first rail, wherein the first sleeve set screw is configured for disengaging the first rail so as to allow the position of the first sleeve to be varied along the length of the first rail, wherein the anchor bolt holder has a second sleeve set screw that is configured for engaging the second rail so as to fix the position of the second sleeve with respect to the second rail, wherein the second sleeve set screw is configured for disengaging the second rail so as to allow the position of the second sleeve to be varied along the length of the second rail.

5. The anchor bolt positioning system as set forth in claim 1, wherein the anchor bolt holder has an anchor bolt set screw configured for engaging an anchor bolt in order to retain the anchor bolt to the anchor bolt holder, wherein the anchor bolt set screw is configured for disengaging the anchor bolt in order to disengage the anchor bolt from the anchor bolt holder.

6. The anchor bolt positioning system as set forth in claim 5, wherein the anchor bolt holder has a first anchor bolt plate and a second anchor bolt plate, wherein the first anchor bolt plate and the second anchor bolt plate are oriented at a ninety degree angle to one another, wherein the first anchor bolt plate, the second anchor bolt plate, and the anchor bolt set screw are configured for engaging the anchor bolt to retain the anchor bolt to the anchor bolt holder.

7. The anchor bolt positioning system as set forth in claim 1, further comprising a second anchor bolt holder configured for holding a second anchor bolt, wherein the second anchor bolt holder is configured for being selectively positioned along the first rail, wherein the second anchor bolt holder is configured for being selectively positioned along a third rail.

8. The anchor bolt positioning system as set forth in claim 7, further comprising:

the first rail;

the second rail; and the third rail, wherein the length of the first rail is oriented at a ninety degree angle to the length of the second rail and to the length of the third rail, wherein the length of the second rail is parallel to the length of the third rail, wherein the first anchor bolt holder and the second anchor bolt holder are retained on the first rail such that repositioning the first anchor bolt holder a particular distance along the length of the second rail causes a corresponding repositioning of the second anchor bolt holder an identical distance along the length of the third rail.

9. The anchor bolt positioning system as set forth in claim 8, further comprising:

a fourth rail;

a third anchor bolt holder configured for holding a third anchor bolt, wherein the third anchor bolt holder is configured for being selectively positioned along the length of the second rail, wherein the third anchor bolt holder is configured for being selectively positioned along a length of the fourth rail; and a fourth anchor bolt holder configured for holding a fourth anchor bolt, wherein the fourth anchor bold holder is configured for being selectively positioned along the length of the third rail, wherein the fourth anchor bolt holder is configured for being selectively positioned along the length of the fourth rail;

wherein the length of the fourth rail is oriented at a ninety degree angle to the length of the second rail and to the length of the third rail, wherein the length of the fourth rail is parallel to the length of the first rail;

wherein the third anchor bolt holder and the fourth anchor bolt holder are retained on the fourth rail such that repositioning the third anchor bolt holder a particular distance along the length of the second rail causes a corresponding repositioning of the fourth anchor bolt holder an identical distance along the length of the third rail;

wherein the first anchor bolt holder and the third anchor bolt holder are retained on the second rail such that repositioning the first anchor bolt holder a particular distance along the length of the first rail causes a corresponding repositioning of the third anchor bolt holder an identical distance along the length of the fourth rail;

wherein the second anchor bolt holder and the fourth anchor bolt holder are retained on the third rail such that repositioning the second anchor bolt holder a particular distance along the length of the first rail causes a corresponding repositioning of the fourth anchor bolt holder an identical distance along the length of the fourth rail.

10. An anchor bolt positioning system, comprising:

an anchor bolt holder having an anchor bolt set screw, wherein the anchor bolt set screw is configured for engaging an anchor bolt in order to retain the anchor bolt to the anchor bolt holder, wherein the anchor bolt set screw is configured for disengaging the anchor bolt in order to disengage the anchor bolt from the anchor bolt holder, wherein the anchor bolt holder is configured for being selectively positioned with respect to a form so that the anchor bolt is capable of being placed at a desired location with respect to the form, wherein once the anchor bolt holder is positioned to a desired location with respect to the form the anchor bolt is embedded in concrete.

11. The anchor bolt positioning system as set forth in claim 10, wherein the anchor bolt set screw is capable of engaging anchor bolts having various diameters such that anchor bolts of various diameters are capable of being engaged to the anchor bolt holder.

12. The anchor bolt positioning system as set forth in claim 10, wherein the anchor bolt holder has a first anchor bolt plate and a second anchor bolt plate, wherein the first anchor bolt plate and the second anchor bolt plate are oriented at a ninety degree angle to one another, wherein the first anchor bolt plate, the second anchor bolt plate, and the anchor bolt set screw are configured for engaging the anchor bolt when the anchor bolt is retained to the anchor bolt holder.

13. The anchor bolt positioning system as set forth in claim 10, further comprising a rail, wherein the anchor bolt holder is configured for being selectively positioned along the rail so that the anchor bolt holder can be selectively positioned with respect to the form.

14. The anchor bolt positioning system as set forth in claim 13, further comprising a second rail, wherein the anchor bolt holder is configured for being selectively positioned along the second rail so that the anchor bolt holder can be selectively positioned with respect to the form.

15. The anchor bolt positioning system as set forth in claim 14, wherein the anchor bolt holder has a first sleeve that surrounds a portion of the first rail, wherein the anchor bolt holder has a second sleeve that surrounds a portion of the second rail, wherein the first sleeve is capable of sliding along the length of the first rail, wherein the second sleeve is capable of sliding along the length of the second rail, wherein the anchor bolt holder has a first sleeve set screw that is configured for engaging the first rail so as to fix the position of the first sleeve with respect to the first rail, wherein the first sleeve set screw is configured for disengaging the first rail so as to allow the position of the first sleeve to be varied along the length of the first rail, wherein the anchor bolt holder has a second sleeve set screw that is configured for engaging the second rail so as to fix the position of the second sleeve with respect to the second rail, wherein the second sleeve set screw is configured for disengaging the second rail so as to allow the position of the second sleeve to be varied along the length of the second rail.

16. The anchor bolt positioning system as set forth in claim 10, further comprising:

a first rail;

a second rail, wherein the first anchor bolt holder engages the first rail and is capable of sliding along the length of the first rail so as to be selectively positioned with respect to the form, wherein the first anchor bolt holder engages the second rail and is capable of sliding along the length of the second rail so as to be selectively positioned with respect to the form; and a second anchor bolt holder that engages the first rail and is capable of sliding along the length of the first rail so as to be selectively positioned with respect to the form, wherein the second anchor bolt holder is configured for engaging a second anchor bolt in order to retain the second anchor bolt to the second anchor bolt holder.

17. The anchor bolt positioning system as set forth in claim 16, further comprising:

a third rail, wherein the second anchor bolt holder engages the third rail and is capable of sliding along the length of the third rail so as to be selectively positioned with respect to the form;

a fourth rail;

a third anchor bolt holder that engages the second rail and is capable of sliding along the length of the second rail so as to be selectively positioned with respect to the form, wherein the third anchor bolt holder engages the fourth rail and is capable of sliding along the length of the fourth rail so as to be selectively positioned with respect to the form, wherein the third anchor bolt holder is configured for engaging a third anchor bolt in order to retain the third anchor bolt to the third anchor bolt holder; and a fourth anchor bolt holder that engages the third rail and is capable of sliding along the length of the third rail so as to be selectively positioned with respect to the form, wherein the fourth anchor bolt holder engages the fourth rail and is capable of sliding along the length of the fourth rail so as to be selectively positioned with respect to the form, wherein the fourth anchor bolt holder is configured for engaging a fourth anchor bolt in order to retain the fourth anchor bolt to the fourth anchor bolt holder;

wherein the first anchor bolt holder and the second anchor bolt holder engage first rail such that repositioning the first anchor bolt holder a particular distance along the length of the second rail causes a corresponding repositioning of the second anchor bolt holder an identical distance along the length of the third rail;

wherein the first anchor bolt holder and the third anchor bolt holder engage the second rail such that repositioning the first anchor bolt holder a particular distance along the length of the first rail causes a corresponding repositioning of the third anchor bolt holder an identical distance along the length of the fourth rail;

wherein the third anchor bolt holder and the fourth anchor bolt holder engage the fourth rail such that repositioning the third anchor bolt holder a particular distance along the length of the second rail causes a corresponding repositioning of the fourth anchor bolt holder an identical distance along the length of the third rail;

wherein the fourth anchor bolt holder and the second anchor bolt holder engage the third rail such that repositioning the fourth anchor bolt holder a particular distance along the length of the fourth rail causes a corresponding repositioning of the second anchor bolt holder an identical distance along the length of the first rail.

18. The anchor bolt positioning system as set forth in claim 17, further comprising:

a fifth rail;

a fifth anchor bolt holder that engages the fifth rail and is capable of sliding along the length of the fifth rail so as to be selectively positioned with respect to the form, wherein the fifth anchor bolt holder engages the second rail and is capable of sliding along the length of the second rail so as to be selectively positioned with respect to the form, wherein the fifth anchor bolt holder is configured for engaging a fifth anchor bolt in order to retain the fifth anchor bolt to the fifth anchor bolt holder; and a sixth anchor bolt holder that engages the fifth rail and is capable of sliding along the length of the fifth rail so as to be selectively positioned with respect to the form, wherein the sixth anchor bolt holder engages the third rail and is capable of sliding along the length of the third rail so as to be selectively positioned with respect to the form, wherein the sixth anchor bolt holder is configured for engaging a sixth anchor bolt in order to retain the sixth anchor bolt to the sixth anchor bolt holder;

wherein the fifth anchor bolt holder and the sixth anchor bolt holder engage the fifth rail such that repositioning the fifth anchor bolt holder a particular distance along the length of the second rail causes a corresponding repositioning of the sixth anchor bolt holder an identical distance along the length of the third rail;

wherein the fifth anchor bolt holder and the first anchor bolt holder and the third anchor bolt holder engage the second rail such that repositioning the fifth anchor bolt holder a particular distance along the length of the fifth rail causes a corresponding repositioning of the first anchor bolt holder an identical distance along the length of the first rail and a corresponding repositioning of the third anchor bolt holder an identical distance along the length of the fourth rail;

wherein the sixth anchor bolt holder and the second anchor bolt holder and the fourth anchor bolt holder engage the third rail such that repositioning the sixth anchor bolt holder a particular distance along the length of the fifth rail causes a corresponding repositioning of the second anchor bolt holder an identical distance along the length of the first rail and a corresponding repositioning of the fourth anchor bolt holder an identical distance along the length of the fourth rail.

19. The anchor bolt positioning system as set forth in claim 16, wherein the position of the second rail is fixed with respect to the form, and wherein the position of the first rail is capable of being changed with respect to the form.

20. An anchor bolt positioning system, comprising:

a first anchor bolt holder having an anchor bolt set screw configured for engaging a first anchor bolt in order to retain the first anchor bolt to the first anchor bolt holder;

a second anchor bolt holder having an anchor bolt set screw configured for engaging a second anchor bolt in order to retain the second anchor bolt to the second anchor bolt holder;

a first rail, wherein the first anchor bolt holder engages the first rail and is capable of being selectively positioned along the length of the first rail, wherein the position of the first anchor bolt holder with respect to the first rail is capable of being fixed by a set screw; and a second rail, wherein the first anchor bolt holder engages the second rail and is capable of being selectively positioned along the length of the second rail, wherein the position of the first anchor bolt holder with respect to the second rail is capable of being fixed by a set screw;

wherein the second anchor bolt holder engages the first rail and is capable of being selectively positioned along the length of the first rail, wherein the position of the second anchor bolt holder with respect to the first rail is capable of being fixed by a set screw, wherein the second anchor bolt holder does not engage the second rail.

* * * * *